United States Patent [19]

Klein

[11] 4,235,358

[45] Nov. 25, 1980

[54] DEVICE FOR THE EDGE OR CENTER CONTROL OF MOVING WEBS

[75] Inventor: Hermann Klein, Reichshof, Fed. Rep. of Germany

[73] Assignee: Elektro-Mechanik GmbH, Fed. Rep. of Germany

[21] Appl. No.: 919,629

[22] Filed: Jun. 27, 1978

[30] Foreign Application Priority Data

Jul. 7, 1977 [DE] Fed. Rep. of Germany ..... 2730733

[51] Int. Cl.[3] ..... B65H 25/08; B65H 25/26

[52] U.S. Cl. ..... 226/22

[58] Field of Search ..... 226/22, 23, 18, 19, 226/21, 45, 3; 242/57.1; 73/37.7; 137/82, 83, 85

[56] References Cited

U.S. PATENT DOCUMENTS

| | | | |
|---|---|---|---|
| 2,814,487 | 11/1957 | Medkeff | 242/57.1 |
| 3,071,157 | 1/1963 | Robertson et al. | 226/22 X |
| 3,244,340 | 4/1966 | Fife et al. | 226/22 |
| 3,442,428 | 5/1969 | Nilsson | 226/22 X |
| 3,490,674 | 1/1970 | Ott, Jr. et al. | 226/22 X |
| 3,592,372 | 7/1971 | James et al. | 226/22 |
| 3,779,438 | 12/1973 | Nilsson | 226/22 X |
| 3,881,414 | 5/1975 | D'Amato et al. | 226/22 X |

FOREIGN PATENT DOCUMENTS

| | | | |
|---|---|---|---|
| 201182 | 1/1956 | Australia | 242/57.1 |

*Primary Examiner*—Stanley N. Gilreath
*Attorney, Agent, or Firm*—McGlew and Tuttle

[57] ABSTRACT

An arrangement for the web edge control comprises a web edge feeler having a sending and receiving nozzles arranged respectively below and above the side edges of the web which is moved includes a motor pump unit for generating the supply air and the fluid pressure for a control diaphragm drive. The control diaphragm drive comprises a diaphragm which is shiftable by pressure changes to operate an adjusting device for shifting the web for example by tilting its rotatable roller support or by shifting the support to one side or the other. The diaphragm is provided with a differential pressure so that one side is admitted in a zero position with the same pressure as the other side during a time at which the sending and receiving nozzles are partially covered by the web edges up to a desired degree for the zero position setting. The air pressure in the receiving nozzle and the diaphragm space which is connected to the receiving nozzle of the web edge feeler is equal to the air pressure on the diaphragm space which is made adjustable by an adjusting throttle.

5 Claims, 2 Drawing Figures

DEVICE FOR THE EDGE OR CENTER CONTROL OF MOVING WEBS

BACKGROUND OF THE INVENTION

1. Field of the Invention

The invention relates in general to sheet positioning devices and in particular to a new and useful arrangement for the edge or center control of sheets or webs comprising a motor pump unit for generating an air supply and the fluid pressure for a diaphragm drive, and an adjusting device for a pneumatic web edge sensor.

2. Description of the Prior Art

In such devices, the web edge sensor is supplied with air from the motor pump unit, where the position of the running web edge is determined and an air pressure proportional to the position of the web edge is applied as a receiver pressure on the diaphragm drive. This, in turn, conducts a fluid current proportional to the receiver pressure to the adjusting device and displaces the web edge in such a way that it returns into its nominal position. Web edge controls of the above described type are known from U.S. Pat. No. 3,244,340, for example, as well as from German Pat. No. 1,574,638. But the web edge control device according to German Pat. No. 1,574,638 has the disadvantage that the zero point of the diaphragm drive can be changed by atmospheric air pressure fluctuations or by speed fluctuations of the compressor and/or by contamination of the filters, so that the zero point of the adjusting device for the web is also displaced. Besides, it is not possible in this control device to adjust the steepness. If the steepness of the control circuit is varied in the known control device according to U.S. Pat. No. 3,244,340 by varying the supply air pressure, the zero point of the diaphragm drive also changes and thus also the zero point of the adjusting device. Readjustment of the zero point is thus necessary in both known devices, which is effected by shifting a spring on the diaphragm drive. If the supply air is cut off, this results in a considerable zero point error. Besides, it is not possible to change from web edge control to web center control without a major design effort.

SUMMARY OF THE INVENTION

The object of the invention is to provide an arrangement for web edge and web center control, where the zero point position of the diaphragm drive is maintained independent of the pressure of the supply air.

Accordingly it is an object of the invention to provide a device for controlling the position of a web which is advanced over a rotatable guide member which guide member is supported on a pivot mounting for tilting as well as lateral shifting movement and which includes at least one sensor having upper and lower portions adapted to overlie respective upper and lower sides of the web as it is advanced, and including an adjusting device connected to the pivot mounting for moving it to adjust the position of the guide member in the web under the influence of a shifting diaphragm which is located in a control housing and divides the housing into upper and lower diaphragm control spaces and wherein the diaphragm is connected to an actuator part which moves with the diaphragm to operate the adjusting device to shift the web and wherein the upper portion of the sensor is connected to the upper diaphragm space and the lower portion is connected to the lower diaphragm space and fluid pressure is connected to each of the spaces so that one space is adjustable by means of a throttle so that the pressure in the lower space of the diaphragm and the upper receiving nozzle is equal to the upper space of the diaphragm housing and a sending nozzle and the upper space is adjustable for the setting of the zero position so that the pressures are equalized between the upper and lower spaces and the diaphragm does not move.

A further object of the invention is to provide a device for controlling the position of a web which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

GENERAL DESCRIPTION OF THE PREFERRED EMBODIMENTS

Figure 1:
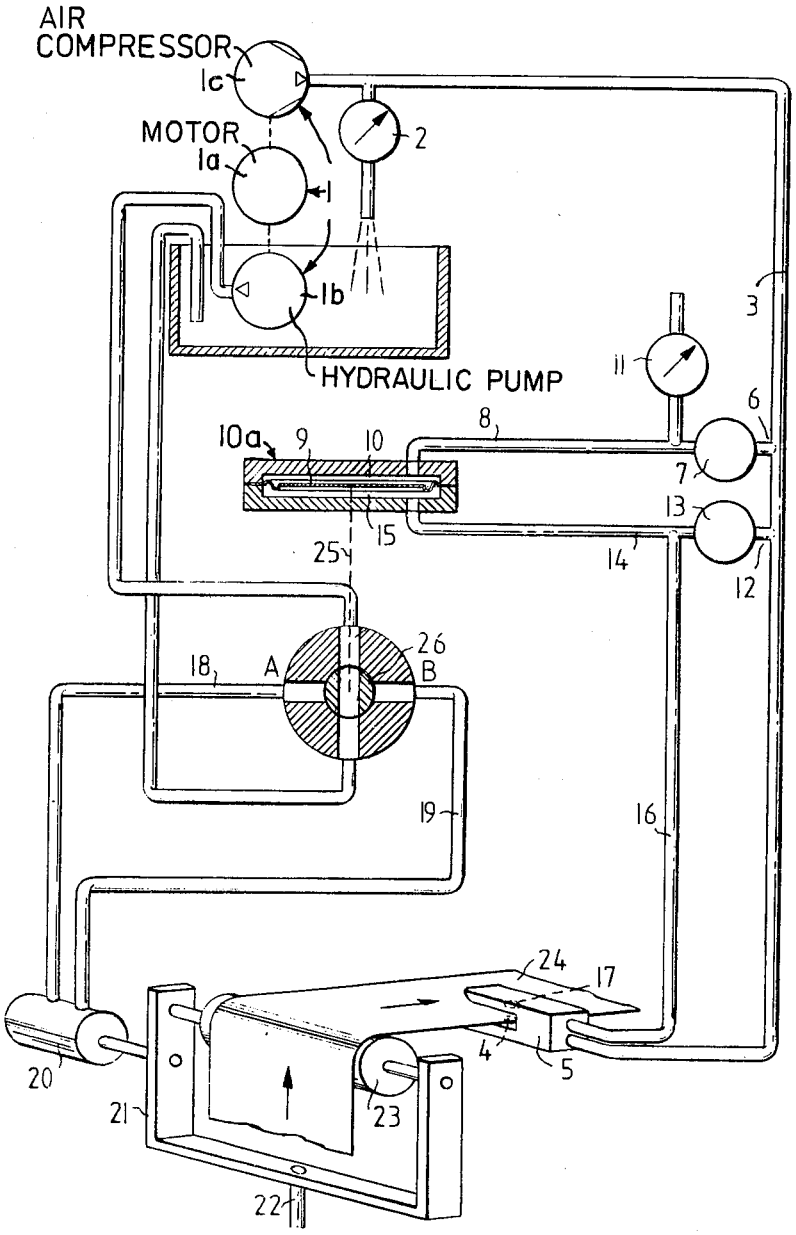
FIG. 1 is a schematic view of an apparatus for controlling the position of a web constructed in accordance with the invention.

Referring to the drawings in particular, the invention embodied therein comprises a device for controlling the position of a web 24 which is advanced over a rotatable guide member 23 and for shifting the web, for example, by either laterally displacing the guide member 23 or by tilting it. For this latter purpose, the apparatus includes an adjusting device or shifting motor 20 which is connected to a mounting means 21 and which is effective to pivot it about a fulcrum support 22 or to shift it relatively to the support.

Compressed air, whose pressure and amount can be adjusted by air escape valve 2, is conducted from a motor pump unit 1, e.g. a double flanged motor 1*a* with flange on hydraulic pump 1*b* for generating a fluid current and a compressor 1*c* for generating the supply air, and is fed over air supply line 3 to sending nozzle 4 of sensor means in the form of a web edge feeler 5. At junction 6, compressed air is withdrawn, via an air flow line from air supply line 3 over a fixed throttle 7 and fed over air line 8 to the upper diaphragm space 10 formed by the differential pressure diaphragm 9 in diaphragm housing 10*a*. The air pressure can also be adjusted in the line 8 by adjusting throttle 11, which is designed as a variable air outlet throttle to atmosphere. The compressed air withdrawn via an air flow line at junction 12 over fixed throttle 13 and supplies both a lower diaphragm space 15 in housing 10*a* over line 14 and receiving nozzle 17 of web edge feeler 5 over conductor air line 16. These four throttles, namely the two fixed throttles 7 and 13, the adjusting throttle 11, and the receiving nozzle 17, form together a pneumatic full bridge connection with differential pressure diaphragm 9 arranged in its bridge diagonal. Differential pressure diaphragm 9 is connected through a motion reversing gear 25 to a rotary valve 26 which produces a fluid current in the fluid lines 18 and 19 generated by motor pump unit 1 when the differential pressure diaphragm 9 is deflected from the zero position. The schematically illustrated rotary valve 26 may be of a known type such as described in German Auslegeschrift 2,300,306 which discloses a multiple path valve having a distributor disc which is mounted for rotary movement relative to a surrounding casing so as to affect various alignments in flow paths through different elevations depending on the rotary position of the disc.

Figure 2:
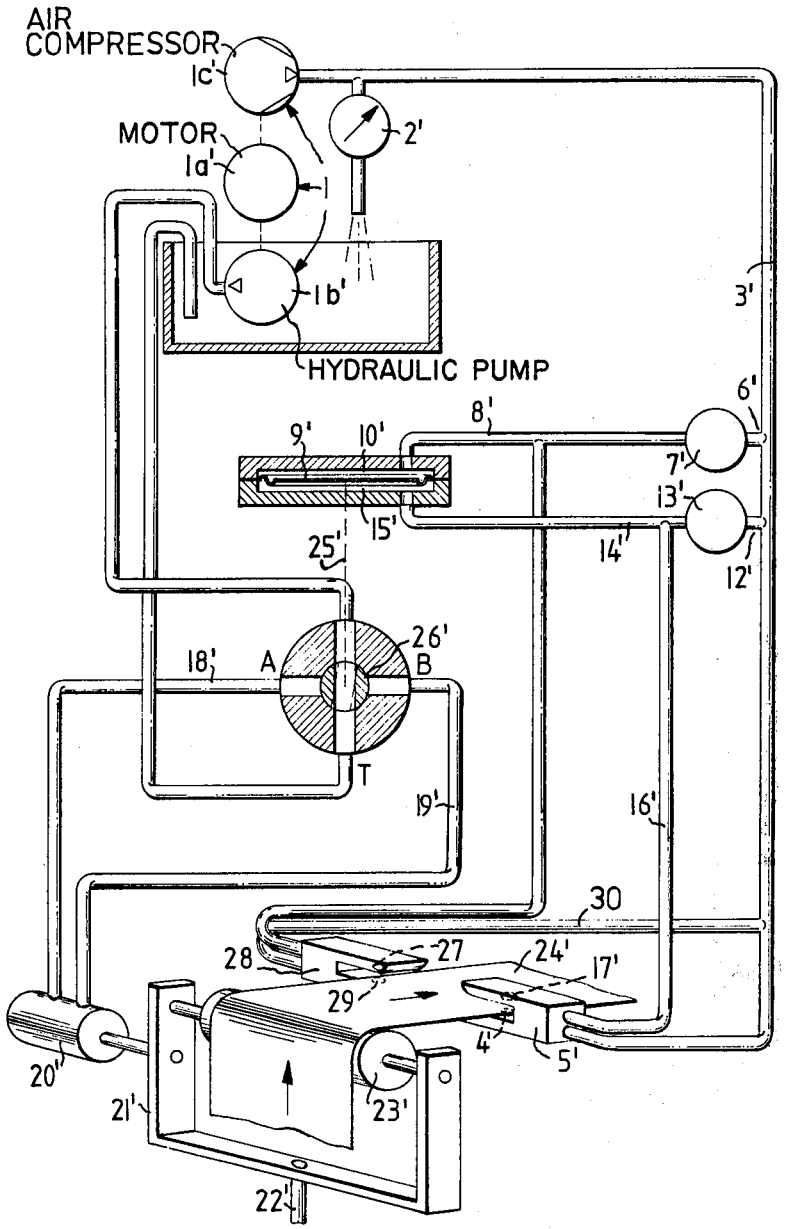
FIG. 2 is a view similar to FIG. 1 of another embodiment of the invention.

As it can be seen from FIG. 2 where parts similar to the FIG. 1 embodiment are designated with the same number but with a prime, adjusting throttle 11 has been replaced by receiving nozzle 27 of a second web edge feeler 28 which supplies the upper diaphragm space 10 with the dynamic pressure of receiving nozzle 27. Sending nozzle 29 of the second web edge feeler 28 is connected to air supply line 3 via a line 30. The invention works as follows:

In the nominal position of material web 24, that is, when sending nozzle 4 and receiving nozzle 17 of web edge feeler 5 are half covered, the compressed air is so adjusted in line 8 by adjusting throttle 11 that the diaphragm spaces 10 and 15 have the same pressure, and diaphragm 9 is thus in the so-called zero position, since it is admitted from both sides with the same air pressure. If web 24 is now deflected from the nominal position, the air pressure in diaphragm space 15 varies by the increasing or decreasing of the dynamic pressure in receiving nozzle 17. The variation of the pressure results in a pressure difference in diaphragm spaces 10 and 15, so that diaphragm 9 is moved out of its zero position, actuating rotary valve 26 to move the reversing gear 25 in such a way that fluid currents are produced in channels A and B and in lines 18 and 19, so that adjusting device 20 swings out a pivot mounting 21 rotatably supporting roller 23 about a support fulcrum 22 in an amount corresponding to the force of the fluid current until the material web 24 is returned into its nominal position.

The mode of operation of the web center control of FIG. 2 is similar to that of the above-described web edge control:

In the nominal position of material web 24', that is, with equal covering of both pairs of nozzles 4' and 17' and 27 and 29 of the two web edge feelers 5 and 28, respectively; the two diaphragm spaces 10' and 15' have the same pressure and differential pressure diaphragm 9' is thus in zero position. When the width of material web 24' varies, the dynamic pressures in receiving nozzles 17' and 27 vary likewise, which results in a pressure difference in differential pressure diaphragm 9', which in turn causes a movement of differential pressure diaphragm 9' and thus also of rotary valve 26'. The resulting fluid currents in channels A and B and in lines 18' and 19' ensure that material web 24' is brought back into its nominal position by the operation of the adjusting device 20' and web guide support means or pivot mounting 21'.

The advantage of the arrangement according to the invention is that the pressure in the diaphragms spaces 10 and 15 is always the same regardless of the pressure of the supply air with half covering of the sending and receiving nozzles 4, 17 on web edge feeler 5, so that diaphragm 9 maintains its zero position. Another advantage is that the steepness of the control device can be varied by varying the supply air pressure in air outlet throttle 2 without varying the zero position of diaphragm 9.

While specific embodiments of the invention have been shown and described in detail to illustrate the application of the principles of the invention, it will be understood that the invention may be embodied otherwise without departing from such principles.

What is claimed is:

1. A device for controlling the position of a web which is advanced over a guide member comprising:

a diaphragm housing having a chamber, a control diaphragm movably mounted in said housing and dividing said chamber into a first and a second control space, sensor means arranged along an edge of the web and having a sending and receiving nozzle adapted to overlie respective opposite sides of the web as it is advanced, fluid pressure supply means connected to said first control space and said sending nozzle, a conduit connecting said receiving nozzle and said second control space, said receiving nozzle being disposed with respect to said sending nozzle in dynamic fluid communication with fluid pressure emitted by said sending nozzle responsive to the position of the web, said diaphragm being movable responsive to a fluid pressure variation between said spaces from a zero position wherein each of said spaces is equally pressurized, throttle means operatively connected to one of said first and second control spaces for varying the pressure thereof, a mounting means for rotatably supporting the guide member, adjusting means operatively connected to said mounting means for shifting said mounting means and guide member, and a reversing means connected to said diaphragm and said adjusting means for shifting said mounting means and guide member responsive to movement of said diaphragm, a first flow line, a first fixed throttle in said first flow line for fixedly throttling flow therethrough, said first flow line being connected to said conduit and said fluid pressure supply means, and wherein said fluid pressure supply means includes a second flow line, a second fixed throttle in said second flow line for fixedly throttling flow therethrough, said second flow line connecting said fluid pressure supply means and said first control space, and said throttle means including an adjustable throttle discharging to atmosphere disposed in fluid communication with said second flow line.

2. A device according to claim 1, wherein said reversing means includes hydraulic fluid pump means, a hydraulic conduit connecting said pump means with said adjusting means for hydraulically operating said adjusting means, valve means in said hydraulic conduit for producing currents of hydraulic fluid to said adjusting means responsive to the variation of said diaphragm from said zero position.

3. A device according to claim 2, wherein said sensor means includes second sending and receiving nozzles arranged along an opposite edge of the web and adapted to overlie respective opposite sides of the web as it is advanced, said second sending and receiving nozzles being connected to respective first and second control spaces of said control housing.

4. A device according to claim 1, further comprising a fulcrum supporting said mounting means to permit pivoting movement of said mounting means and lateral shifting movement thereof, and said guide member comprising a rotatable drum.

5. A device according to claim 2, further comprising a drive motor operatively connected to said hydraulic fluid pump means, and said fluid pressure supply means being driven by said drive motor.

* * * * *